US005123461A

United States Patent [19]

Belokin, Jr. et al.

[11] Patent Number: 5,123,461

[45] Date of Patent: Jun. 23, 1992

[54] NESTABLE CONTAINER FOR DISPENSING AND DRAINING LIQUID THEREFROM

[76] Inventors: Paul Belokin, Jr.; Martin P. Belokin, both of 7801 1-35N & Milam Rd., Denton, Tex. 76201

[21] Appl. No.: 680,320

[22] Filed: Apr. 4, 1991

[51] Int. Cl.[5] ..... B65D 17/20

[52] U.S. Cl. ..... 141/98; 141/331; 141/337; 141/322; 206/519; 206/520; 222/460; 222/478; 222/481; 220/276

[58] Field of Search ..... 141/337, 331, 325-327, 141/320, 322; 220/266, 270, 272, 276, 288, 380, 625, 666, 667, 670, 671, 672, 673, 231; 206/634, 499, 503, 507, 519, 520; 222/460, 143, 478, 481, 541

[56] References Cited

U.S. PATENT DOCUMENTS

| | | | |
|---|---|---|---|
| 3,425,382 | 2/1969 | Johnson | 206/519 |
| 3,437,233 | 4/1969 | Rathbun | 206/519 X |
| 3,874,553 | 4/1975 | Schultz et al. | 220/276 X |
| 4,049,122 | 9/1977 | Maxwell | 206/519 |
| 4,082,184 | 4/1978 | Hammer | 206/519 |
| 4,231,476 | 11/1980 | Compton et al. | 206/519 |
| 4,557,394 | 12/1985 | Luker | 215/317 |
| 4,848,623 | 7/1989 | Saunders et al. | 220/276 X |
| 4,883,198 | 11/1989 | Manska | 222/481 X |
| 4,976,367 | 12/1990 | Hoefler | 220/260 |

FOREIGN PATENT DOCUMENTS

| | | | |
|---|---|---|---|
| 0250100 | 12/1987 | European Pat. Off. | 206/520 |
| 1201792 | 1/1960 | France | 206/519 |
| 6409030 | 2/1966 | Netherlands | 206/520 |

*Primary Examiner*—Ernest G. Cusick
*Attorney, Agent, or Firm*—Nilles & Nilles

[57] ABSTRACT

A container for dispensing and draining liquid held therein is disclosed wherein the container is nestable with like containers prior to filling and after the liquid therein has been dispensed. The container comprises a body including a longitudinal axis, a side wall, a large bottom end, and a small top dispensing end. The side wall tapers from the bottom end to the top end of the container to define a tapered liquid defining space having inner and outer side wall surfaces and bottom and top openings at the top and bottom ends. The top end of the container is adapted to receive a readily removable top cap and the bottom end is adapted to receive a readily removable tear-type bottom closure. During initial manufacture, the bottom end is left open so that the containers may be nested for shipment to the filling point. During dispensing, the readily removable top and bottom ends of a first container are removed so that the large bottom end of the first empty container becomes a funnel and holder for the small top end of a subsequent container that is to be emptied.

12 Claims, 5 Drawing Sheets

NESTABLE CONTAINER FOR DISPENSING AND DRAINING LIQUID THEREFROM

FIELD OF THE INVENTION

This invention relates to a container for liquids such as automotive lubricating oil and to a method for dispensing oil into an engine or the like and to aid in disposing of empty nested containers.

DESCRIPTION OF THE RELATED ART

Lubricating oils are customarily placed into an easy open disposable container made of metal, plastic or liquid impervious paper board. Such containers are produced by a container manufacturer who also prints the required graphics thereon. The empty finished containers are then shipped to the lubricating oil supplier for filling and subsequent sale to end users such as filling stations and do-it-yourself consumers who dispense the oil and dispose of the container. Millions of these containers are manufactured annually and the shipping, dispensing, draining and recycling of such containers presents such serious longstanding, unsolved problems that many states and local communities are adopting laws in an attempt to prevent environmental contamination and to mandate recycling of such containers.

Containers presently in use present problems to the container manufacturer, the end user and the recycler. The manufacturer that produces the container prints the necessary graphics thereon to finish the container. The finished container is then shipped to the filling plant. Present finished containers are not nestable after manufacture and printing of graphics thereon. Therefore the cost of shipping is high due to the high volume to weight ratio of empty shipped containers. Further, the rigors of shipping can damage the graphics making the container less attractive at its point of sale unless packing precautions are taken.

The end user finds present containers awkward and difficult to dispense oil from without spilling. When dispensing oil, the location of engine components frequently requires the end user to hold the container above the engine oil filler opening and this makes it difficult to initially accurately align the container's dispensing opening with the engine oil filler opening. Consequently, the initial stream of oil may miss the opening and there is frequently some spillage. Further, air gurgling into the container at this time causes the falling stream to oscillate back and forth over a wide area promoting additional spillage. This problem could be mitigated by a funnel but the practical fact is that funnels are seldom if ever used because they are not conveniently at hand, awkward to use, slow down the filling and are messy to clean or dispose of. When more than one container of oil must be dispensed, as during an oil change, this spill-prone procedure is repeated several times. To solve the problem, it has been suggested that an engine oil filler cap be constructed with a self-contained funnel as disclosed in U.S. Pat. No. 4,338,983, issued Jul. 13, 1982 to Hatcher, or that the neck of the container be configured as disclosed in U.S. Pat. No. 4,832,322, issued May 23, 1989 to Matthews et al, to minimize gurgling.

Residual oil in the empty oil container has long been recognized as presenting a contamination problem. The viscous nature of oil causes significant amounts to cling to the inside of the container, especially when oil is dispensed in cold weather. If the container is simply discarded in a dump site, the residual oil contaminates the land. If the empty container is recycled, the residual oil makes the recycling process more difficult and expensive. Therefore, increasingly strict laws are being enacted regarding the handling and disposal of such containers and to make their recycling mandatory.

The prior art contains suggestions for devices and methods to drain empty oil containers and U.S. Pat. No. 2,807,290, issued Sept. 24, 1957 to Hearn, is typical. Such devices and methods drain one or more containers individually and are inefficient because one container must be removed before another can be drained. When many containers must be drained, the user is encouraged to remove a container before it is fully drained so that another can be drained. Further, prior art containers and drain methods do not in any way facilitate the consolidation of the drained containers for recycling.

It has long been obvious that empty discarded containers occupy an exceedingly large volume of space. While crushing the empty containers is one effective way to consolidate them, in actual practice crushing is so time-consuming that most empty containers are not crushed. Thus, while the consolidation problem has been recognized for decades, the prior art has not suggested a container designed to be nested for consolidation nor a method for its consolidation when empty that can be carried out in an easy and practical manner.

In my prior U.S. Pat. No. 4,316,551, issued Feb. 23, 1982, I teach that the side wall of a cylindrical container be provided with rows of individual embossments to aid in axial crushing. In addition to its nesting, dispensing and consolidation advantages, the present invention improves upon my earlier patent. The present invention provides a simpler design which will facilitate nesting and crushing if such is desired, and which is lower in cost to manufacture.

SUMMARY OF THE INVENTION

The present invention comprises a container which is nestable both prior to filling and after the liquid therein has been dispensed. This container is designed to be nestable by the container manufacturer after the graphic material has been printed thereon in order to significantly increase the number of containers that can be shipped in a given volume of space thereby reducing shipping costs. In addition, after the liquid therein has been dispensed the container is designed so that it again becomes nestable thus permitting a large number of such containers to be consolidated into a nested condition for draining of any residual liquid remaining therein which automatically consolidates them for efficient shipment to a recycling point.

More specifically, the container comprises a body including a longitudinal axis, a side wall means, a bottom end, and a top dispensing end. The side wall means tapers from the bottom end to the top end of the container to define a tapered liquid defining space having inner and outer side wall surfaces and bottom and top openings at the top and bottom ends. The top end of the container has a means adapted to receive a removable top closure. Similarly, the bottom end has a peripheral edge means adapted to receive a removable bottom closure means.

Preferably the container body will comprise a larger truncated cone bottom section and a smaller truncated cone top section with the angular degree of taper of the bottom cone section relative to the longitudinal axis of the container being smaller than the degree of taper of the top section relative to the longitudinal axis. The bottom truncated cone section may include a bottom end and a first interfacing end having a first diameter and the top truncated cone section may include a top end and a second interfacing end having a second diameter that is less than the first diameter. The first and second interfacing ends of the bottom and top truncated cone sections are connected together by a shoulder defining a plane of weakness.

In addition, the body may have one or a plurality of shoulders axially spaced apart along the axis to define a single plane or a plurality of planes of weakness transverse to the axis along which the container will collapse in response to a crushing applied in a direction parallel to the axis.

Preferably the top end of the body will have a threaded dispensing portion and the top closing means will comprise an internally threaded cap having an external surface that lies inside of a theoretical extension of the outer side wall surface axially from the top end from the body.

The invention also includes, in combination, the container and a residual liquid collector for successively receiving a plurality of said empty containers in a nested relationship to permit residual liquid to drain therefrom and to consolidate a plurality of said empty containers for recycling. The collector includes an upper portion having a tapered socket presenting an inverted open apex for receiving therein the tapered outer side wall surface of an inverted empty container body with said top and bottom closure means removed to permit residual liquid to drain therefrom into a holding receptacle. The tapered socket is dimensioned so that in use it will hold the container initially placed therein securely to permit successive containers to be axially aligned and inserted into the open bottom end of a preceding container to nest therein for consolidation and draining of residual liquid from a plurality of such containers.

The method of the present invention for filling an engine or the like having an oil filler opening by dispensing oil from an oil container of the type above described comprises the steps of:

A. removing said cap to open the top end of a first container, inverting the first container and inserting the open top end in the engine oil filler opening; and B. removing the quick removable cover to open the bottom end cross-sectional area of the container to permit rapid and complete emptying of the first container.

The method for filling an engine may also comprise the additional steps of:

C. taking a second container and removing the cap thereof to open the top end and inserting it in the open bottom end of the first container whereby the first container becomes a funnel for guiding the oil dispensed from said top end of the second container;

D. removing the quick removable cover to open the bottom cross-sectional area of the second container to permit rapid and complete emptying of the second container; and E. repeating steps C and D as necessary to dispense a third and any subsequent containers of oil into the engine.

The method of the present invention for simultaneously consolidating and draining residual oil from a plurality of emptied oil containers as above described to minimize environmental contamination and facilitate recycling comprises the steps of:

A. providing a residual oil collector means that includes a tapered recess means having an inverted open apex and an oil holding receptacle means;

B. inverting and placing the open dispensing end of a first one of the empty oil containers into the tapered recess;

C. allowing the emptied container to remain in the tapered recess to permit draining of residual oil from the top dispensing end;

D. inverting and placing the open top dispensing end of a second one of the empty oil containers into the open end of said first container and moving the second empty container downward into the tapered liquid confining chamber of the first container until the second container is fully nested within the first container;

E. repeating steps C and D for each subsequent emptied oil container that is to be allowed to drain until a desired number of containers has been consolidated in the collector and drained of residual oil; and F. removing said consolidated nested drained containers from the collector for recycling.

BRIEF DESCRIPTION OF THE DRAWINGS

Referring to the drawings.

DESCRIPTION OF THE PREFERRED EMBODIMENTS

Figure 1:
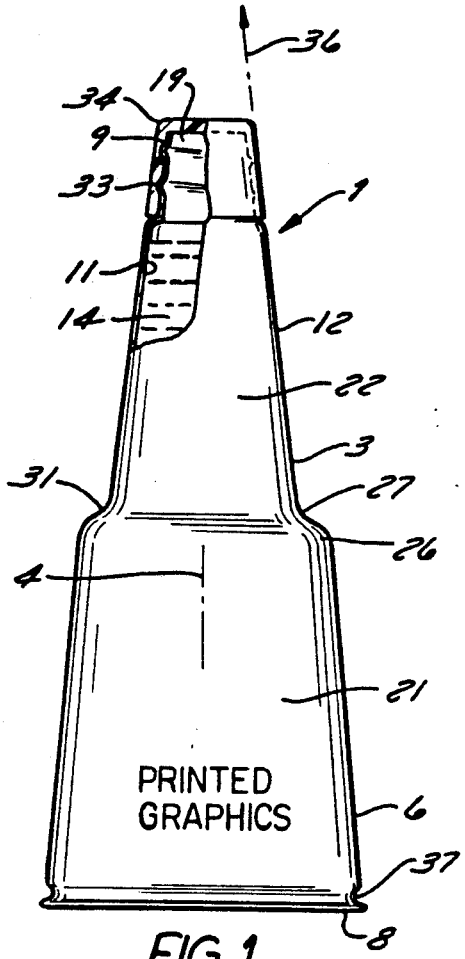
FIG. 1 is a side elevational view of a liquid container embodying the invention.
Figure 5:
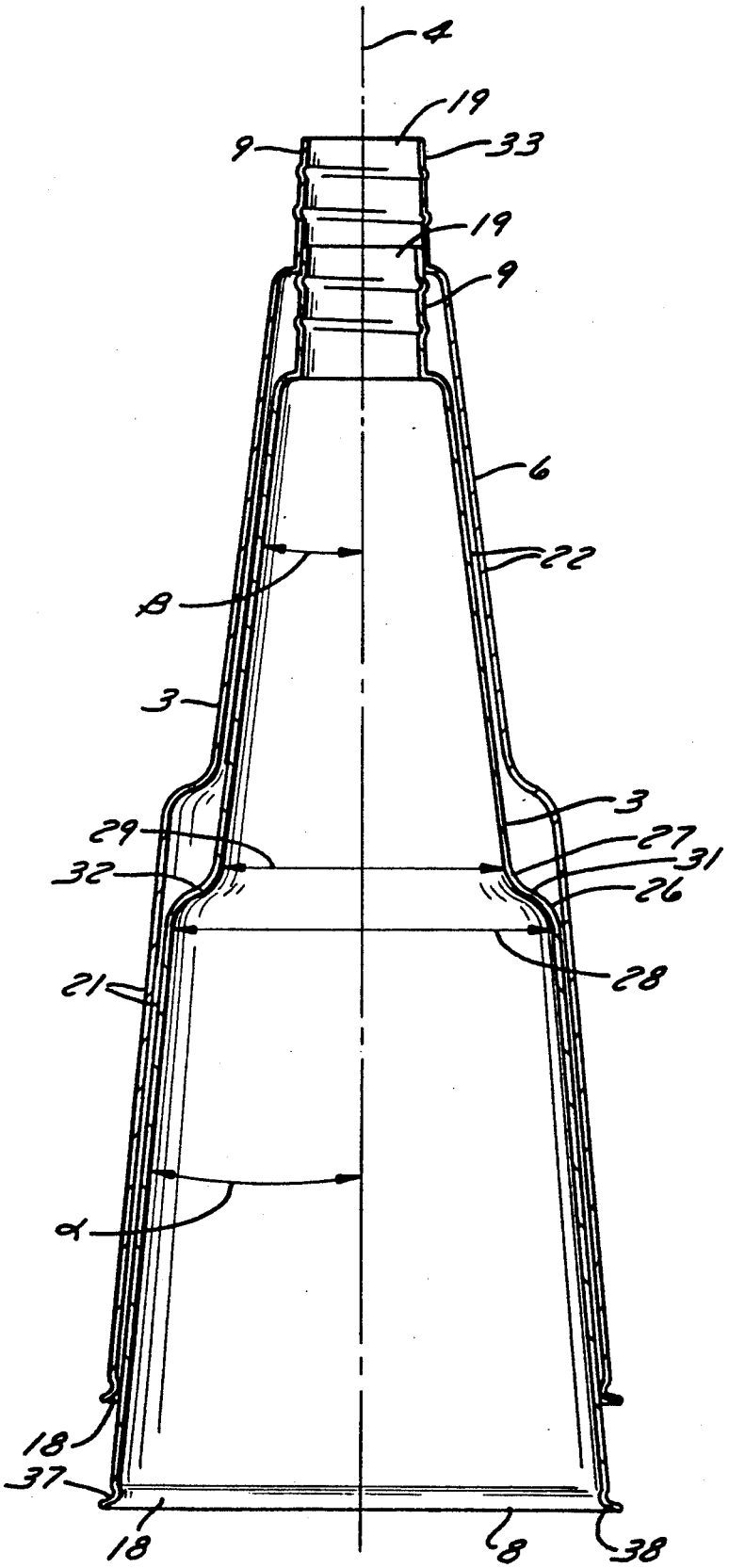
FIG. 5 is an enlarged sectional view showing two of the containers in a nested condition.

A first embodiment of the container 1 is shown in FIGS. 1 and 5. The container 1 comprises a body 3 which includes a longitudinal axis 4, a side wall means 6, a bottom end 8, a top dispensing end 9, and inner and outer side wall surfaces 11 and 12. The side wall means 6 tapers from the bottom end 8 to the top end 9 to define a tapered liquid confining space or chamber 14 having bottom and top openings 18 and 19 at the bottom and top ends 8 and 9 of the body 3.

As shown in FIGS. 1 and 5, the body portion 3 comprises a lower or bottom section 21 in the form of a large truncated cone and an upper top section 22 in the form of a smaller truncated cone. The angle $\alpha$ of taper of the side wall of the bottom cone section relative to a longitudinal axis 4 is smaller than the angle $\beta$ of taper of the top section 22 relative to the longitudinal axis. The bottom section 21 includes the open bottom end 8 and a first interfacing end 26 that has a first diameter 28. The top truncated cone section 22 includes the open top end 9 and a second interfacing end 27 having a second diameter 29 that is less than the first diameter. The first and second interfacing ends 26 and 27 are joined together by a transition shoulder 31 which defines a plane of weakness 32 transverse to the axis 4 along which the container will collapse when compressed in a direction parallel to the axis. In the embodiment of FIG. 1, the body has only one shoulder 31 defining a single plane of weakness. However, if desired, the body could, as shown in the second embodiment of FIG. 6, have a plurality of shoulders 132 axially spaced apart along the longitudinal axis of the container to define a plurality of planes of weakness.

The top end 9 of the body 3 is reduced in diameter and has a threaded dispensing portion 33. A conventional top closure means in the form of an internally threaded cap 34 is provided for removably sealing the top opening 19 of body 3. The threaded cap has an exterior surface configuration dimensioned so that it does not project outside of a theoretical extension 36 of the outer side wall surface 12 of the top truncated cone section projected axially beyond the top end thereof.

Figure 2:
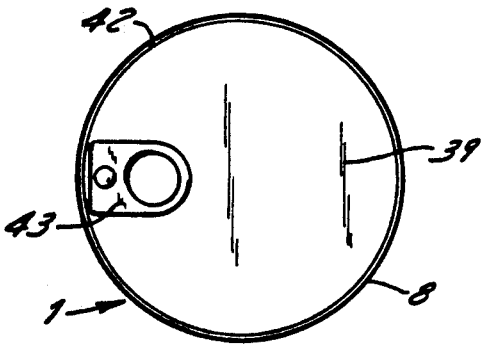
FIG. 2 is a bottom view of the container shown in FIG. 1.

The open bottom end 8 of the container body has a spacer means 37 that projects inwardly from the inner wall surface 11 into the tapered liquid confining chamber or space 14. This spacer means 37 preferably will comprise a peripheral edge 38 formed into the side wall 6 for receiving a tear-type bottom closure means or cover 39 (FIG. 2). The spacer means 37 will serve to prevent the inner wall surface 11 of one container from contacting the adjacent outer wall surface 12 of a like container nested inside thereof to prevent any damage to graphics that may be printed on the containers prior to their shipment to the filling plant. The removable bottom closure means is best shown in FIG. 2 and comprises a conventional metallic disk scored around its outer periphery to define a tear line 42. The bottom closure means 39 further includes a conventional pull tab 43 which when pulled will cause the removable bottom closure to be peeled away and expose the full cross-sectional area of the bottom end 8.

The cross-sectional area of the bottom closure means 39 should be substantially as large as the cross-sectional area of the bottom 8 of the container body 3 to expose substantially all of the interior of chamber 14 so that when nesting occurs, each successive container can be axially inserted into the preceding container to the maximum distance possible.

While the container is shown as circular in cross section, other cross-sectional shapes can be used provided the container is tapered in the direction of axis 4.

The container as above described may be produced by the container manufacturer who will normally print suitable graphics thereon as required by the end user and install the top closure cap 34 but not the bottom closure 39. The container manufacturer can nest the containers because the bottom end 8 remains open. The spacer means 37 at the bottom end 8 prevents the inner wall surface 11 of one container from contacting the adjacent outer wall surface 12 of a like container nested inside. Damage to graphics is likely when shipping aluminum containers, and the spacer means 37 minimizes the risk of such damage occurring.

Figure 6:
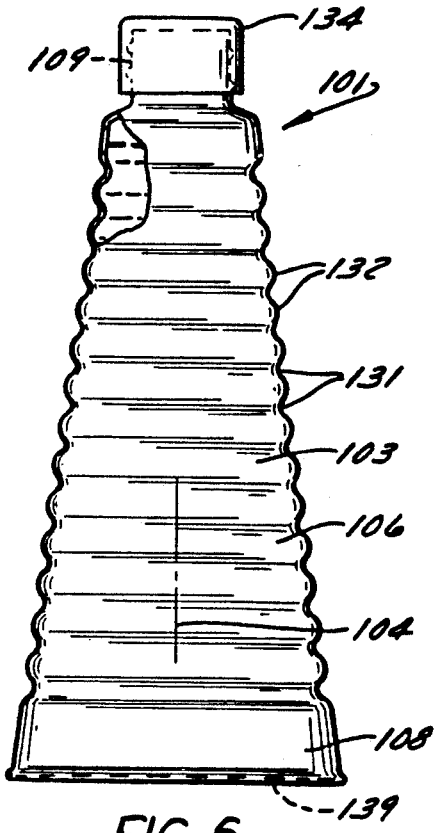
FIG. 6 shows a second embodiment of the container shown in FIG. 1.

The second embodiment of the container identified by reference number 101 is shown in FIG. 6 and is similar in construction to the container 1 of the first embodiment. The container 101 of the second embodiment comprises a body 103 which includes a longitudinal axis 104, side wall means 106, a bottom end 108 and a top dispensing end 109. The top and bottom ends are provided with a top cap 134 and a bottom tear-type closure 139, respectively, that are the same as top closure 34 and bottom closure 39 of the first embodiment and therefore no further description of these elements will be made.

The side wall means 106 includes a plurality of shoulders 132 which define a plurality of planes of weaknesses 131 transverse to axis 104. The side wall means 106 tapers uniformly so that starting at the top each successively lower shoulder 132 is slightly larger than the shoulder above it. Axial compression will collapse the container with the shoulders lying partially within each other to provide the maximum degree of compacting possible with a minimum amount of axial force.

The container of both embodiments is especially useful for automotive lubricating oil but can be used for other liquids as well. The containers of both embodiments will function in the same manner. Therefore the following description of dispensing oil, the method of filling an engine and the method of draining residual oil from empty containers to automatically consolidate the containers will apply to the containers of both embodiments.

Figure 4:
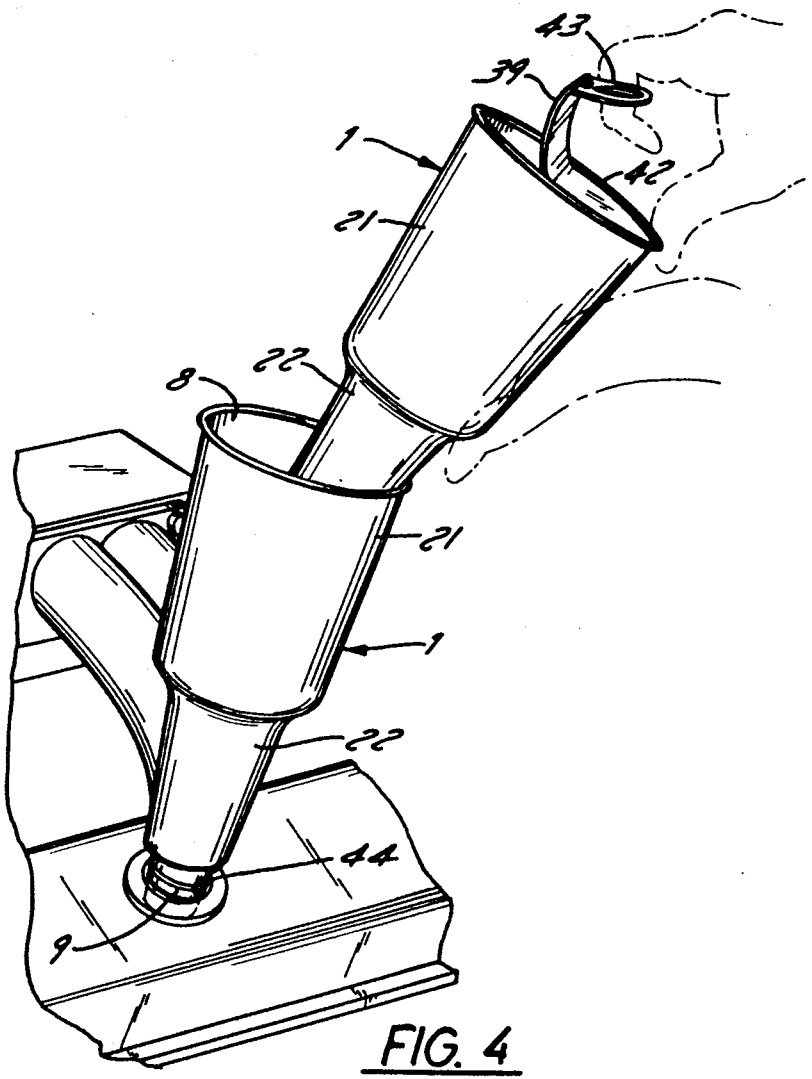
FIG. 4 is an isometric projection similar to FIG. 3 showing the first container of FIG. 3 being utilized as a funnel to facilitate the dispensing of oil from a second container.
Figure 3:
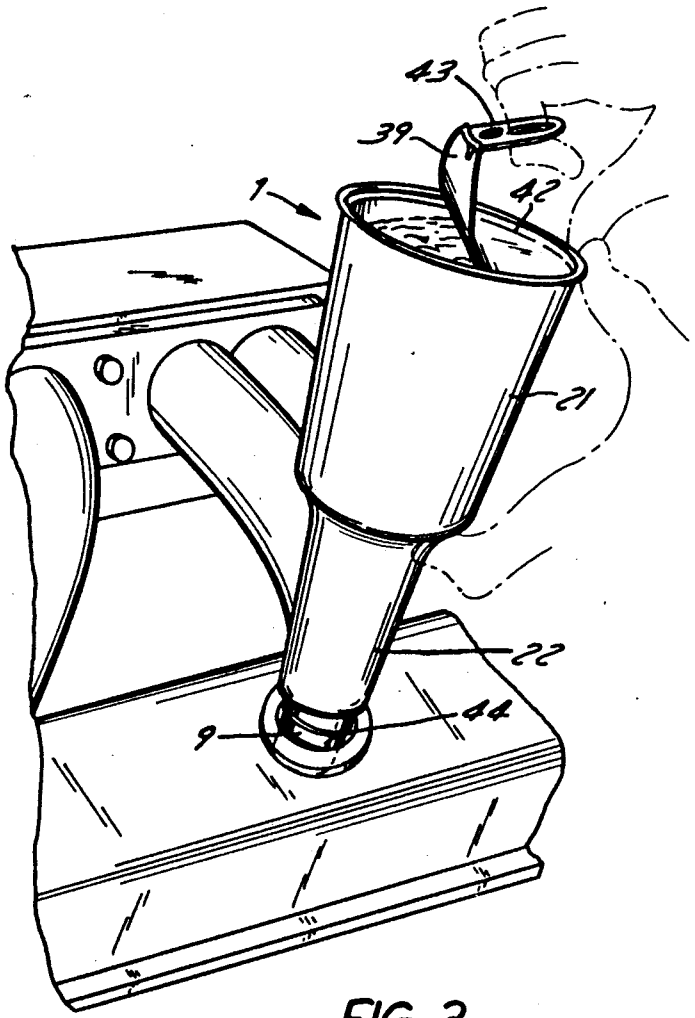
FIG. 3 is an isometric projection view of the container dispensing oil into an engine of a vehicle.

The method of dispensing oil to fill an engine is shown in FIGS. 3 and 4 and comprises the steps of:

A. removing the cap to open the top end of a first container 1, inverting the first container and inserting the open top end 9 in the engine oil filler opening 44; and B. removing the quick removable cover 39 to open the entire bottom end cross-sectional area of the container to permit rapid and complete emptying of the first container.

Figure 7:
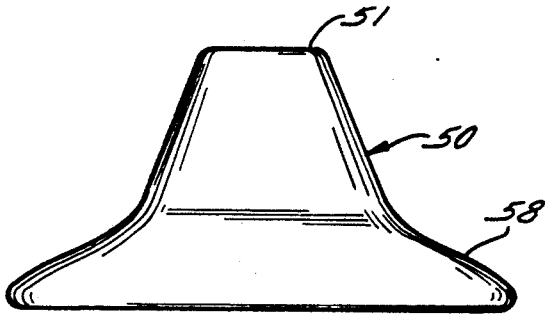
FIG. 7 is a side elevational view of a first embodiment of a residual oil collector for use in collecting residual oil from open containers constructed in accordance with the present invention.
Figure 8:
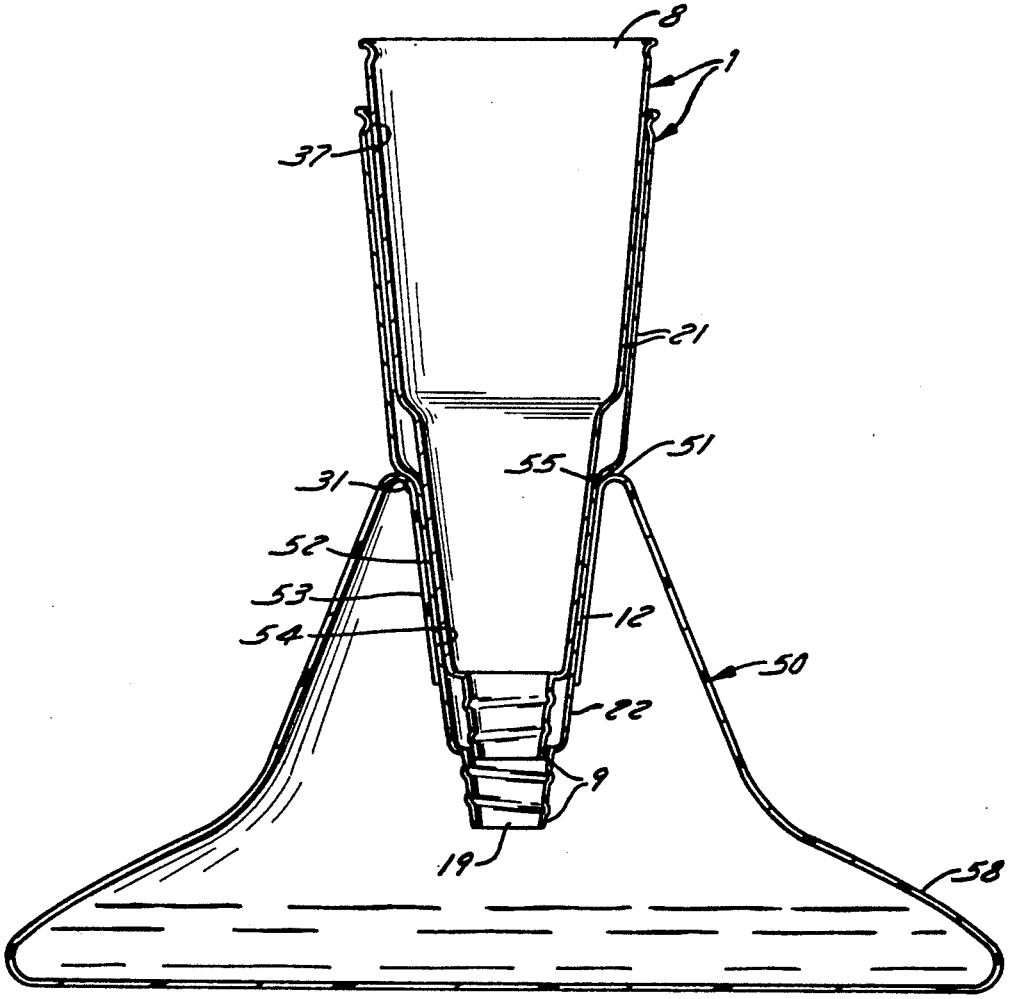
FIG. 8 is an enlarged sectional view of the residual oil collector shown in FIG. 7 holding two inverted nestable containers constructed according to the present invention.
Figure 9:
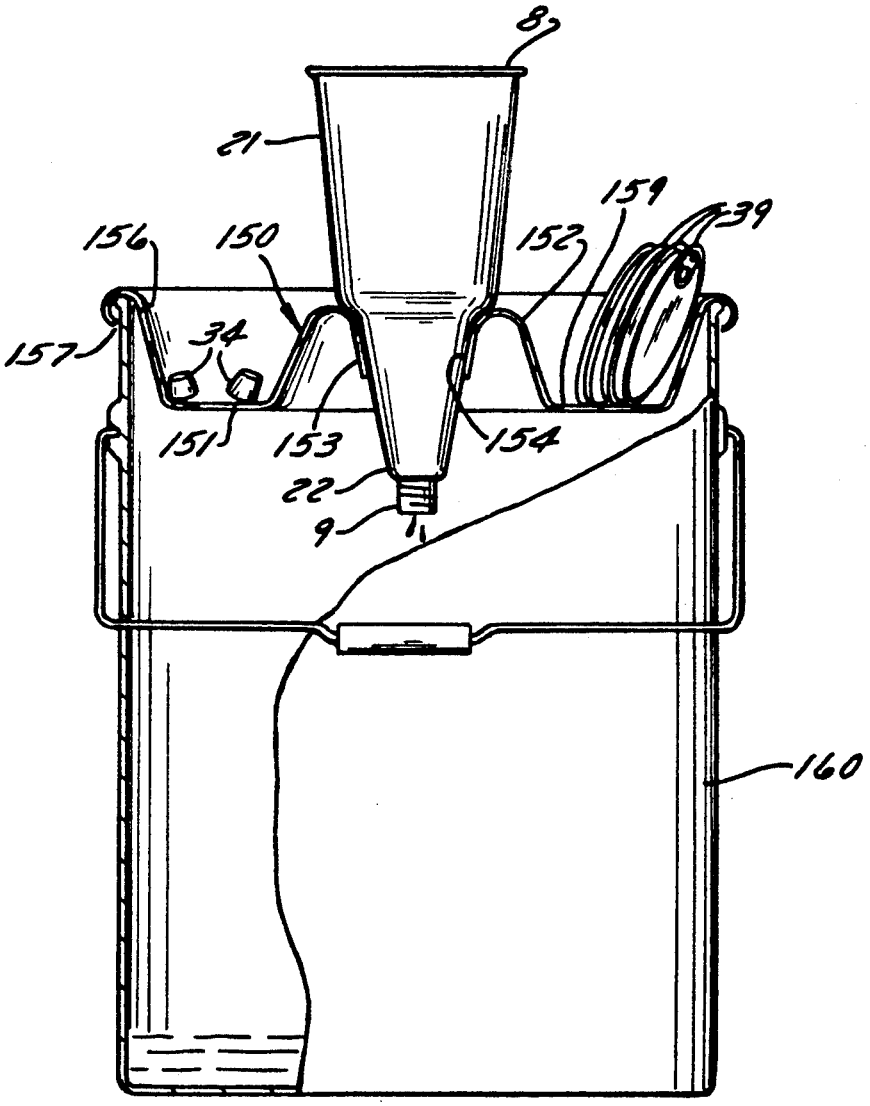
FIG. 9 shows a second embodiment of the residual oil collector.

The narrow tapered top portion or neck 9 facilitates the alignment of the top dispensing opening 19 with the oil filler opening 44 of the engine. With the tear-off, quick removable bottom closure cover 39 removed, the entire bottom end cross-sectional area of the container 1 is open and atmospheric air is vented into the container to maximize the rate of flow of the oil into the engine. If only one container of oil is to be dispensed, the empty container will be removed from the engine oil filler opening and placed in a collector device as shown in FIGS. 7, 8 or 9, as will be more fully described hereinafter.

As shown in FIG. 4, if additional containers of oil are to be dispensed, the method comprises the additional steps of:

C. taking a second container 1 and removing the cap 34 thereof to open the top end 9 and inserting it in the open bottom end of the first container whereby the open bottom end 18 of the first container becomes a funnel for guiding the oil dispensed from the top end of the second container;

D. removing the quick removable cover 39 to open the entire bottom cross-sectional area of the second container 1 to permit rapid and complete emptying of the second container; and E. repeating steps C and D as necessary to dispense a third and any subsequent containers of oil into the engine.

From the above description it will be understood that removal of the tear-off bottom closure 39 will automatically convert the first container into a funnel for receiving the next container which is to be emptied. As the body portions 3 of each container are designed to nest one within the other, each succeeding container will be securely held by the preceding container. If all of the oil has been drained from an engine, the dispensing of several containers of oil one after the other is made very easy as each preceding container is used as a funnel for the next following container to be dispensed. The funnel function of each empty container virtually assures that no oil will be spilled. When all of the containers have been dispensed, the four or five nested containers may be removed as a unit and placed as a unit into the residual oil drain collector shown in FIGS. 7, 8 or 9.

FIGS. 7 and 8 show a first embodiment of a residual oil collector 50 and FIG. 9 shows a second embodiment of the residual oil collector 150. In the first embodiment of FIGS. 7 and 8, the residual oil collector 50 comprises an upper portion 51 including a center section 52. The center section has a wall means 53 defining a tapered socket portion 54 having an inverted open apex. The socket 54 is dimensioned and configured to receive the top section 22 of the container 1 so that the outer surface 12 will tightly mate against the wall 53 of the tapered socket 54 in a wedge fit relationship. The tapered socket 54 may have a top edge 55 having a radius configured to mate with the shoulder 31 of the container for added support, although this is not essential. The collector 50 also includes an integral receptacle means 58 for holding the drained residual oil. The residual oil receiving collector 50 is provided with a conventional drain opening, not shown, so that the collected oil may be emptied therefrom for proper disposal.

The second embodiment of the residual oil collector 150 as shown in FIG. 9 utilizes a standard five-gallon pail 160 as the receiving receptacle. The residual oil collector 150 comprises an upper portion 151 having a center section 152. The center section has a wall means 153 defining a tapered socket 154 corresponding to the tapered socket 54 of the first embodiment shown in FIGS. 7 and 8. The tapered socket 154 is dimensioned to receive empty containers in the same manner as described hereinabove with respect to the first embodiment. The upper portion 151 includes an outer peripheral edge 156 provided with a circumferential groove 157 dimensioned to receive the upper edge of the conventional five-gallon can 160. The upper portion 151 is also provided with an annular tray 159 depressed to provide a trough that is concentric with the center tapered socket 154. The depressed tray is adapted to receive and hold the removable top caps 34 and bottom closures 39 of the containers.

The method for simultaneously consolidating and draining residual oil from a plurality of emptied oil containers 1 and 101 constructed as above described, to minimize environmental contamination and facilitate recycling comprises the steps of:

A. placing the residual oil collector means 50 or 150 with its tapered socket 54 or 154 and oil holding receptacle means 58 or 160 in a suitable convenient place, as for example at the self-service pump island of a filling station;

B. inverting and placing the open top dispensing end 9 of a first one of the empty oil containers into the tapered socket;

C. allowing the emptied container to remain in the tapered socket to permit draining of residual oil from the top dispensing end 9;

D. inverting and placing the open top dispensing end 9 of a second empty oil container into the open bottom end 18 of the first container and moving the second empty container axially downward into the tapered liquid confining chamber 14 of the first container until the second empty container is fully nested within the first container;

E. repeating steps C and D for each subsequent emptied oil container that is to be allowed to drain until a desired number of containers has been consolidated in the collector and drained of residual oil; and then F. removing the consolidated nested drained containers from the collector for recycling.

When the first empty oil container 1 is inverted and inserted into the collector 50, it is snugly received therein in the tapered socket and thereby stabilized against lateral displacement, as shown in FIG. 8. Because the container 1 is held securely, a large number of succeeding empty oil containers may be placed successively in the collector and allowed to remain as long as desired in order to achieve full and complete draining of residual oil therefrom. The drained containers can be removed as a unit of nested containers for efficient shipping to a recycling point.

When the collector 50 or 150 is placed at the pump island, the foregoing method has the advantage that most customers will automatically nest the cans for draining after the oil has been dispensed instead of throwing the container into the rubbish can. Once a container is nested in the residual oil collector, the container need never again be handled as an individual unit thus maximizing the efficiency of handling and recycling. Because the used can bodies are compactly nested after draining, they will have a low volume-to-weight ratio to minimize the cost of shipping them to the recycling point.

What is claimed is:

1. A container for liquids which is nestable with at least one other like container when said at least one other like container is empty prior to filling and after the liquid therein has been dispensed comprising:

a body including a longitudinal axis, a large bottom end, a small top dispensing end that is smaller than said large bottom end and side wall means tapering from said large bottom end to said small top end to define a tapered liquid confining space having inner and outer side wall surfaces and large bottom and small top openings at said bottom and top ends;

a removable bottom closure means that is readily removable without tools for sealing said large bottom opening; and a removable top closure means that is readily removable without tools for sealing said smaller top opening.

2. The container according to claim 1 wherein:

said body comprises a larger truncated cone bottom section and a smaller truncated cone top section; and said taper of said bottom cone section relative to said longitudinal axis is less than said taper of said top section relative to said longitudinal axis.

3. The container according to claim 2 wherein:

said bottom truncated cone section includes said large bottom end and a first interfacing end having a first diameter;

said top truncated cone section includes said small top end and a second interfacing end having a second diameter that is less than said first diameter; and a transition shoulder is provided in said side wall means that connects said first and second interfacing ends together.

4. The container according to claim 1 wherein said body has at least one shoulder defining a plane of weakness transverse to said axis along which said container will collapse when compressed in a direction parallel to said axis.

5. The container according to claim 4 wherein said body has a plurality of shoulders axially spaced apart along said axis to define a plurality of planes of weakness.

6. The container according to claim 1 wherein said top end has a threaded dispensing portion and said top closure means comprises an internally threaded cap having an exterior surface that does not project outside of a theoretical extension of said outer side wall surface axially from said top end of said body.

7. A container for liquid products which is nestable with at least one other like container when said at least one other like container is empty prior to filling and after the liquid therein has been dispensed comprising:

a body including a longitudinal axis, a large bottom end, a small top dispensing end that is smaller than said large bottom end and side wall means tapering from said large bottom end to said small top end to define a tapered liquid confining space having inner and outer side wall surfaces and large bottom and small top openings at said bottom and top ends;

said small top end having means adapted to receive a removable top closure means readily removable without tools; and said large bottom end having a peripheral edge means adapted to receive a removable bottom closure means that is readily removable without tools.

8. The container according to clam 7 wherein said bottom end has a spacer means projecting inward from said inner wall surface into said tapered space to prevent said inner wall surface from contacting an adjacent outer wall surface of a like container nested inside said liquid confining space and prevent damage to any graphics that may be printed thereon.

9. The container according to claim 8 wherein said peripheral edge for receiving said bottom closure means projects inward from said inner wall surface and constitutes said spacer means.

10. The container according to claim 7 wherein:

said body comprises a larger truncated cone bottom section and a smaller truncated cone top section; and said taper of said bottom cone section relative to said longitudinal axis is less than said taper of said top section relative to said longitudinal axis.

11. The container according to claim 10 wherein:

said bottom truncated cone section includes said large bottom end and a first interfacing end having a first diameter;

said top truncated cone section includes said small top end and a second interfacing end having a second diameter that is less than said first diameter; and said first and second interfacing ends are connected together by a transition shoulder.

12. The container according to claim 7 wherein said top end has a threaded dispensing portion and said top closure means comprises an internally threaded cap having an exterior surface that lies inside of an extension of said outer side wall surface axially from said top end of said body.

* * * * *